United States Patent [19]

Braun et al.

[11] 4,323,392

[45] Apr. 6, 1982

[54] AGENT FOR DESULFURIZING CRUDE IRON AND STEEL MELTS, AND PROCESS FOR MAKING IT

[76] Inventors: Albert Braun; Willi Portz; Georg Strauss, all of Hoechst Aktiengesellschaft, Werk Knapsack, Hürth-Knapsack, Fed. Rep. of Germany

[21] Appl. No.: 148,565

[22] Filed: May 9, 1980

[30] Foreign Application Priority Data

May 14, 1979 [DE] Fed. Rep. of Germany ..... 2919324

[51] Int. Cl.[3] ..... C21C 7/02

[52] U.S. Cl. ..... 75/58; 75/53

[58] Field of Search ..... 75/53, 58

[56] References Cited

U.S. PATENT DOCUMENTS 3,598,573 8/1971 Freissmuth ..... 75/58

3,666,445 5/1972 Stone ..... 75/53

4,194,902 3/1980 Gmohling ..... 75/58

*Primary Examiner*—P. D. Rosenberg

*Attorney, Agent, or Firm*—Connolly and Hutz

[57] ABSTRACT

The invention provides an agent for desulfurizing crude iron and steel melts, the desulfurizing agent being based on calcium carbide containing calcium oxide. The desulfurizing agent is produced by admixing a calcium carbide melt having up to 45 weight % of calcium oxide therein with an excess of 3 to 15 weight %, based on the CaO-content of more than 45 up to 80 weight % desired for the final product, of calcium oxide. The resulting mixture is allowed to solidify and cool down to temperatures of 350° to 450° C. Next, the solidified melt is precrushed to material with a size of less than 150 mm. Particles with a size of less than 4 mm are screened off and the remaining material is comminuted, with the exclusion of moisture, to material with a size of less than 10 mm.

6 Claims, No Drawings

AGENT FOR DESULFURIZING CRUDE IRON AND STEEL MELTS, AND PROCESS FOR MAKING IT

The present invention relates to an agent for desulfurizing crude iron and steel melts, the desulfurizing agent being based on calcium carbide containing calcium oxide, and to a process for making it.

It has been described that metal melts can be desulfurized with the use of calcium carbide (briefly termed carbide hereinafter) and more especially with the use of carbide containing calcium oxide (briefly termed lime hereinafter) together with fluor spar.

A process for making such desulfurizing agent has been described in German Pat. No. 20 37 758, wherein a melt of relatively high percentage carbide has addends admixed therewith, the addends being used in the form of a mixture of lime and fluor spar, which are used in the form of particles with a size of less than 20 mm, preferably 0.5 to 10 mm, and which contain less than 5 weight %, preferably less than 0.5 weight % of water of crystallization or adhering water.

In the manner described, it is possible to produce carbide which contains more than 45 up to 65% of $CaC_2$ but only about 25 to 26.5% of CaO. Practical tests made on these mixtures have however shown the fluor spar component heavily to corrode materials such as those normally used for coating or lining desulfurization vessels, so that these mixtures have actually failed to gain commercial interest.

Carbide containing 20 up to 55 weight % of $CaC_2$ and more than 45 up to 80 weight % of CaO, prepared as described hereinafter and kept free from the relatively expensive fluor spar addend, has now unexpectedly been found to be better suited for use in the desulfurization of crude iron and steel melts.

The desulfurization agent of this invention is more particularly produced by admixing a customary calcium carbide melt having up to 45 weight % of calcium oxide therein with an excess of 3 to 15 weight %, based on the CaO-content desired for the final product, of fine particulate calcium oxide; allowing the resulting mixture to solidify and cool down to a temperature of 350° to 450° C.; pre-crushing the solidified melt at that temperature to material with a size of less than 150 mm; screening off particles with a size of less than 4 mm; and further crushing and grinding the remaining material, with the exclusion of moisture, to material with a size of less than 10 mm.

The carbide should preferably be so extended in a crucible, utilizing the carbide's heat content.

In those cases in which calcium oxide preheated to temperatures of up to 2000° C., preferably up to 1100° C., is added to the carbide melt, it is possible to establish therein a CaO-content of up to 80 weight %, the CaO being preferably preheated to a temperature which is the higher within the range specified the higher the proportion of additionally dissolved calcium oxide to be established within the range 45 to 80 weight %. Carbide so treated can be used for treatment of iron and steel melts containing little carbon, the desulfurization yield being incidentally increased.

The calcium carbide melts used as starting material in accordance with this invention should more preferably contain between 20 and 45 weight % of CaO.

The fine particulate material (less than 4 mm in size) which is screened off after the precrushing step, consists essentially of CaO. It is therefore good practice for it to be recycled and used again in the process, together with fresh CaO as feed material.

It has also been found advantageous to use calcium oxide in the form of particles which combine a size of 1 to 8 mm with a content of less than 1 weight % of $Ca(OH)_2$ and $CaCO_3$, respectively.

The step of screening off, after the precrushing operation, all those particles, which have a size of less than 4 mm would not have been expected by the artisan to effect the removal of material which has none or an insignificant desulfurization efficiency only, or formation of a final product of improved activity. It is also an unexpected result that the present product is considerably easier to grind than prior art material. This is highly desirable inasmuch as it is often necessary for the product to be used in particles with a size of less than 100 microns.

EXAMPLE 1

Calcium carbide was produced electrothermally in the present Example, from lime and coke. The furnace burden contained the lime/coke-mixture in a ratio by weight of 100:40. This corresponded to carbide with a CaO-content of about 40 weight %.

Injected into the jet of liquid carbide tapped off from the furnace into a crucible was CaO which was in the form of particles with a size of 3 to 8 mm and contained less than 1 weight % of $Ca(OH)_2$ and $CaCO_3$, respectively. The CaO was more specifically injected at a velocity and in quantities necessary to have, in the full crucible, an overall $CaC_2$:CaO-ratio by weight of 43:57, corresponding to a 14 weight % excess of CaO, based on the 50 weight % CaO-content desired for the final product. Next, the whole was allowed to cool until the solidified carbon block was found to have an average temperature of about 400° C., and the block was precrushed to material of less than 150 mm in size.

The particles with a size of less than 4 mm obtained during the precrushing step were found to contain the bulk of CaO used in excess. The remaining material consisted of particles with a size larger than 4 mm. It was an intense mixture of 50 weight % $CaC_2$ and 50 weight % CaO. It was ground as usual to particles less than 10 mm in size. Particles smaller than 4 mm in size were screened off and re-used together with fresh lime as feed material.

1500 kg of the product made as described above was introduced at 1400° C. into 300,000 kg of a crude iron melt, of which the sulfur content of initially 0.03 weight % was reduced down to less than 0.005 weight %.

EXAMPLE 2

The procedure was as in Example 1 but CaO was preheated to 1100° C. prior to being added to the carbide melt, and the quantity of CaO was increased so as to have, in the crucible, a CaO-content of 62.5%, corresponding to an excess of 4 weight %, based on the 60 weight % CaO-content desired for the final product.

1800 kg of the product made an ground in accordance with this invention was used at 1650° C. for desulfurizing 300,000 kg of a steel melt, of which the initial sulfur content of 0.02 weight % was reduced to less than 0.005 weight %.

We claim:

1. An agent for desulfurizing crude iron and steel melts, the desulfurizing agent consisting of calcium carbide and calcium oxide and being produced by the steps comprising: preparing a calcium carbide melt containing up to 45 weight % of calcium oxide; introducing into the melt fine particulate calcium oxide in a total amount of more than 48 up to 95 weight % of the final product; allowing the resulting molten mixture to solidify and cool down to a temperature of 350° to 450° C.; precrushing the solidified melt at that temperature to material with a size of less than 150 mm; screening off particles with a size of less than 4 mm; and further crushing and grinding the remaining material, with the exclusion of moisture, to material with a size of less than 10 mm.

2. A process for making an agent for desulfurizing crude iron and steel melts, the desulfurizing agent consisting of calcium carbide and calcium oxide, which process comprises: making a desulfurizing agent containing 20 to 55 weight % of calcium carbide and more than 45 up to 80 weight % of calcium oxide by introducing into a calcium carbide melt containing up to 45 weight % of calcium oxide fine particulate calcium oxide in a total amount of more than 48 up to 95 weight % of the final product; allowing the resulting molten mixture to solidify and cool down to a temperature of 350° to 450° C.; precrushing the solidified melt at that temperature to material with a size of less than 150 mm; screening off particles with a size of less than 4 mm; and further crushing and grinding the remaining material, with the exclusion of moisture, to material with a size of less than 10 mm.

3. The process as claimed in claim 2, wherein the calcium oxide is introduced into the calcium carbide melt inside a crucible.

4. The process as claimed in claim 2, wherein calcium oxide preheated to temperatures up to 2000° C. is introduced into the calcium carbide melt, the calcium oxide being preheated to a temperature which is the higher up to 2000° C. the higher the proportion of additionally dissolved calcium oxide to be established within the range 45 to 80 weight %.

5. The process as claimed in claim 2, wherein the calcium carbide melt used as feed melt contains 20 to 45 weight % of calcium oxide.

6. The process as claimed in claim 2, wherein the particles with a size of less than 4 mm screened off after the precrushing step are recycled.

* * * * *